US008523119B1

(12) United States Patent
Greer et al.

(10) Patent No.: US 8,523,119 B1
(45) Date of Patent: Sep. 3, 2013

(54) PIPE SUPPORT BRACKET

(75) Inventors: James M. Greer, Temecula, CA (US); Larry D. Brown, San Diego, CA (US)

(73) Assignee: Securus, Inc., San Diego, CA (US)

( * ) Notice: Subject to any disclaimer, the term of this patent is extended or adjusted under 35 U.S.C. 154(b) by 1222 days.

(21) Appl. No.: 10/925,593

(22) Filed: Aug. 25, 2004

Related U.S. Application Data

(60) Provisional application No. 60/497,792, filed on Aug. 26, 2003.

(51) Int. Cl.
*F16L 3/08* (2006.01)

(52) U.S. Cl.
USPC ..... 248/65; 248/70; 248/224.8; 248/225.11; D8/354

(58) Field of Classification Search
USPC ..... 248/49, 56, 58, 61, 65, 68.1, 70, 248/71, 73, 74.1, 205.1, 231.9, 224.1, 225.11, 248/247, 317, 77, 57, 74.5, 63; 403/4, 408.1; 4/695, 696; D8/349, 354, 373
See application file for complete search history.

(56) References Cited

U.S. PATENT DOCUMENTS

| | | | | |
|---|---|---|---|---|
| 3,136,515 | A | 6/1964 | Potruch | |
| 3,429,535 | A | 2/1969 | Herzig | |
| 3,556,447 | A | 1/1971 | Jenkins et al. | |
| 4,184,592 | A * | 1/1980 | Howard, Jr. | 206/327 |
| 4,245,806 | A | 1/1981 | Vangreen | |
| D273,760 | S | 5/1984 | Takei | |
| D273,761 | S | 5/1984 | Takei | |
| 4,669,422 | A | 6/1987 | Steudler, Jr. | |
| D313,743 | S * | 1/1991 | Mastrodicasa | D8/381 |
| 5,083,372 | A | 1/1992 | Polutnik et al. | |
| 5,172,877 | A | 12/1992 | Hattori et al. | |
| 5,174,675 | A * | 12/1992 | Martin | 403/4 |
| 5,187,853 | A * | 2/1993 | Bardaville | 29/407.01 |
| 5,257,768 | A | 11/1993 | Juenemann et al. | |
| 5,297,690 | A * | 3/1994 | Bardaville | 220/3.2 |
| 5,366,188 | A | 11/1994 | Kramer et al. | |
| D361,503 | S * | 8/1995 | Hubbard | D8/354 |
| D376,094 | S | 12/1996 | Hubbard | |
| D377,750 | S * | 2/1997 | Hubbard | D8/354 |
| 5,740,994 | A * | 4/1998 | Laughlin | 248/68.1 |

(Continued)

FOREIGN PATENT DOCUMENTS

DE 2825344 * 6/1978

*Primary Examiner* — Tan Le
(74) *Attorney, Agent, or Firm* — Stetina Brunda Garred & Brucker; Lowell Anderson

(57) ABSTRACT

A support bracket is provided for use with a fixture for mounting a water closet connected to a water conduit of radius R. The fixture has a plurality of bolts at predetermined locations to which the bracket is mounted during use of the bracket. The support bracket has an elongated member with a longitudinal axis. A first end of the elongated member has at least one aperture sized and located therein to allow the bracket to be fastened to the bolts on the fixture during use of the bracket. A distal end of the bracket has a shaped opening therein. The shaped opening is formed of overlapping circles, resulting in a hole with circular ends of a radius of about R. The shaped opening has two opposing sides each with a cycloid shape and having opposing cusps of the cycloid shape aligned to define at least two circular openings of a radius of about R. The openings are centered on a straight line perpendicular to the longitudinal axis. The shaped opening can be formed in the bracket, or formed in an insert placed in a hole in the bracket.

17 Claims, 7 Drawing Sheets

(56) References Cited

U.S. PATENT DOCUMENTS

| | | | | |
|---|---|---|---|---|
| 5,992,802 | A | 11/1999 | Campbell | |
| 6,095,462 | A * | 8/2000 | Morgan | 248/82 |
| 6,158,066 | A * | 12/2000 | Brown et al. | 4/695 |
| 6,263,954 | B1 * | 7/2001 | Nakayama | 165/67 |
| D448,657 | S | 10/2001 | Calvert | |
| 6,464,182 | B1 | 10/2002 | Snyder | |
| 6,523,790 | B2 | 2/2003 | Sentpali et al. | |
| 6,629,676 | B1 * | 10/2003 | Gretz | 248/58 |
| 6,631,874 | B2 * | 10/2003 | Turpin et al. | 248/49 |
| 6,857,606 | B1 * | 2/2005 | Gretz | 248/68.1 |

* cited by examiner 26
26
28
33
32
34

38

38

38

24
26
26
32
28
33
34

PIPE SUPPORT BRACKET

RELATED APPLICATION

This application claims the benefit under 35 U.S.C. §119 (e) of provisional application Ser. No. 60/497,792, filed Aug. 26, 2003, the complete content of which is incorporated herein by reference.

FIELD OF THE INVENTION

This invention relates to supports and holders for tubular members such as plumbing pipes.

BACKGROUND OF THE INVENTION

U.S. Pat. No. 5,107,638 to Unertl describes a fixture for mounting water closets such as toilets or urinals directly to the wall of a structure. Unertl describes a floor mounted fixture having an opening for the plumbing drain tube. A bracket is bolted to the fixture and extends upwards and away from the floor, with a hole in the bracket sized to hold a conduit which supplies water to the toilet or urinal. The bracket mounts to threaded studs or bolts that extend from the fixture at predetermined locations, and which determine the lateral position of the bracket relative to the fixture and drain. Unfortunately, when the toilet or urinal is mounted to the fixture, the lateral position of the bracket and the hole in the bracket, is often not aligned with the position of the water inlet on the toilet or urinal. As the bracket positions the water supply conduit, this misalignment between the hole and the water inlet presents problems. There is thus a need for a bracket that allows the position of the hole in the bracket to be adjusted to coincide with the location of the water inlet conduit.

In a broader view existing pipe supports and brackets can have an elongated member with mounting holes, and an opening through which a pipe can extend. The mounting holes are often fastened to pre-existing fixtures, which causes the opening for the pipe to be in a pre-determined location defined by the pipe-opening in the bracket. Unfortunately, the pipe that is to be placed through the pipe-opening is often not located to coincide with the pipe-opening, so the pipe or bracket is bent to allow the pipe to fit through the pipe-opening in the bracket. There is thus a need for a support bracket that accommodates misalignment or offsets of the pipe from the bracket.

BRIEF SUMMARY OF THE INVENTION

A support bracket is provided with an enlarged head sufficient to enclose a plurality of overlapping holes or circular holes spaced apart a distance sufficient to accommodate likely variations in tube or pipe locations. The overlapping holes are preferably of the same radius "R" with the centers of the holes being located on a common axis, and with the holes offset about 0.8R to about 1.8R, and preferably offset about 0.8R to 1.4R and ideally offset a distance about the same as the radius R of the holes. Preferably there are only one or two overlapping holes.

The holes preferably are formed so a lip extends around at least a portion of the circumference of each hole and along the longitudinal axis of the pipe that passes through the hole. Advantageously the lip extends around the entire periphery of the overlapping holes. The lip allows solder or adhesive to be interposed between the lip and the pipe passing through the hole, so as to better fasten the pipe to the bracket. If the bracket is made of metal, the overlapping holes and lip can be stamped from sheet metal. If the bracket is made of plastic, the holes and lip can be molded.

There is thus provided a support bracket for an elongated member having a generally uniform circular cross section of a radius about R. The bracket has an elongated member with a distal end containing a shaped opening formed by two overlapping circles of the same radius R and spaced a distance apart less than the twice the radius, so that an elongated member cannot be placed in each circle during use of the bracket. The circles forming the shaped opening are preferably spaced apart a distance of about the radius R. The shaped opening preferably has an edge with a lip extending from the edge along the length of the elongated member, during use of the bracket. The bracket also preferably has at least one aperture sized to allow the passage of a fastener to fasten the bracket to a fixture during use of the bracket. The at least one aperture is preferably sized to allow the passage of a fastener to fasten the bracket to a water closet mounting fixture during use of the bracket. The shaped opening can be formed in an insert fastened to the distal end, or just formed entirely within and surrounded by the distal end.

The bracket also includes a support bracket for use with a fixture for mounting a water closet connected to a water conduit of radius R, where the fixture has a plurality of bolts at predetermined locations to mount with the bracket during use of the bracket. The support bracket has an elongated member with a longitudinal axis. A first end of the elongated member has at least one aperture sized and located therein to allow the bracket to be fastened to the bolts on the fixture during use of the bracket. A distal end of the b racket has a shaped opening therein, with the shaped opening having circular ends with a radius of about R. The shaped opening has two opposing sides each with a cycloid shape and has opposing cusps of the cycloid shape aligned to define at least two circular openings of a radius of about R. The openings are centered on a straight line perpendicular to the longitudinal axis. Preferably, but optionally, a lip extends from an edge of the shaped opening, with the lip having a cycloid shape. Advantageously there are two openings spaced apart a distance of about R. The first end of the bracket advantageously has a U-shaped cross-section, with the apertures being formed in a bottom of the U-shaped cross section, and with the distal end forming a plate. The shaped opening can be is formed directly in the material of which the distal end is made, or formed in an insert placed in an opening in the distal end.

In a further embodiment, there is provided a support bracket for use with a fixture for mounting a water closet that is connected to a water conduit. The fixture has a plurality of bolts at predetermined locations to which the bracket is mounted during use of the bracket. The support bracket has a fastening end with aperture means for mounting the bracket to the fixture and providing for vertical positioning of the conduit along a longitudinal axis of the bracket during use of the bracket. The bracket has a distal end opposite the fastening end and further has a lateral axis extending through the distal end and perpendicular to the longitudinal axis. There are means on the distal end for positioning the conduit along the lateral axis. The lateral positioning means advantageously comprises a shaped opening formed from overlapping two holes of between about ¾ to about 1 inch diameter. Advantageously there is also provided means for increasing the area of support around a periphery of the shaped opening. Finally, the lateral positioning means is advantageously formed in an insert fastened to the distal end of the support bracket, but could be formed integral with the support bracket itself.

BRIEF DESCRIPTION OF THE DRAWINGS

These and other features and advantages will become better understood by reference to the drawings, in which like numbers refer to like parts throughout.

DETAILED DESCRIPTION OF THE INVENTION

Figure 1:
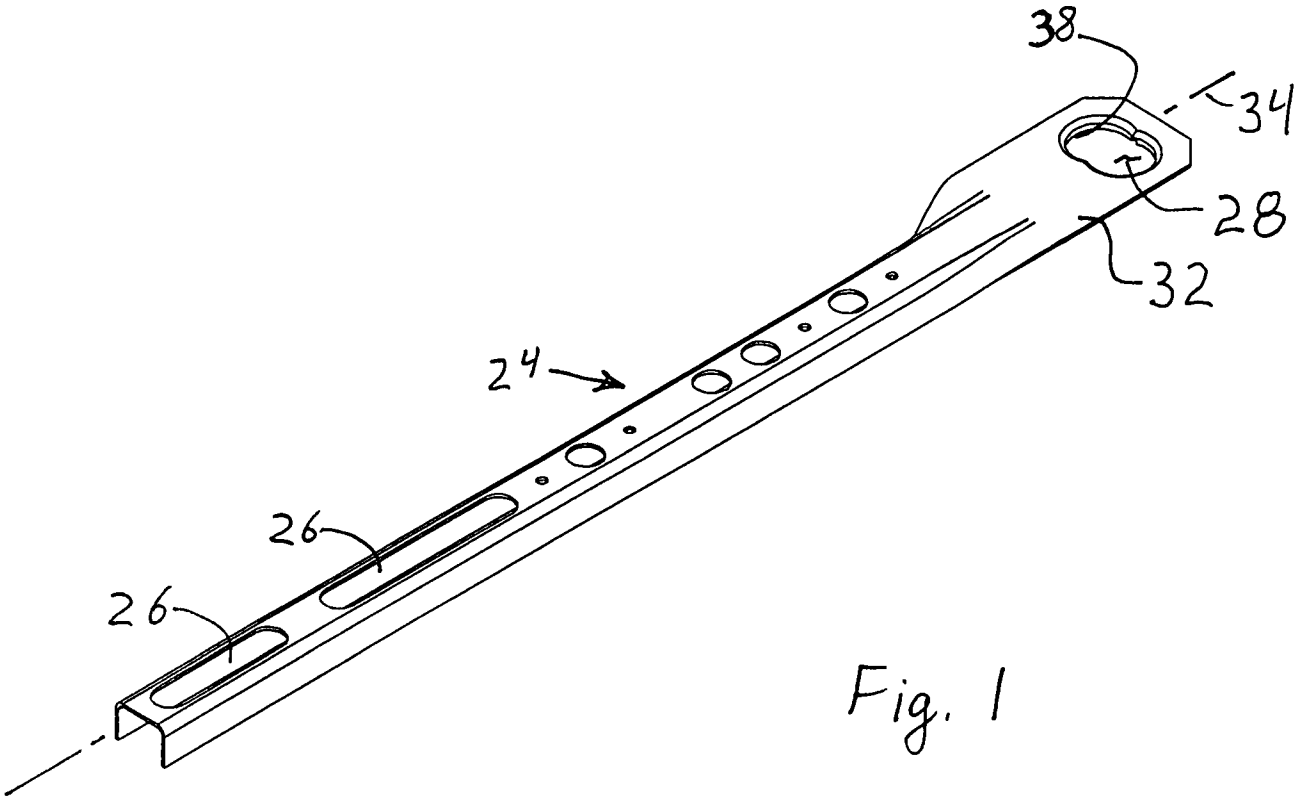
FIG. 1 is a front perspective view of a bracket of this invention.
Figure 8:
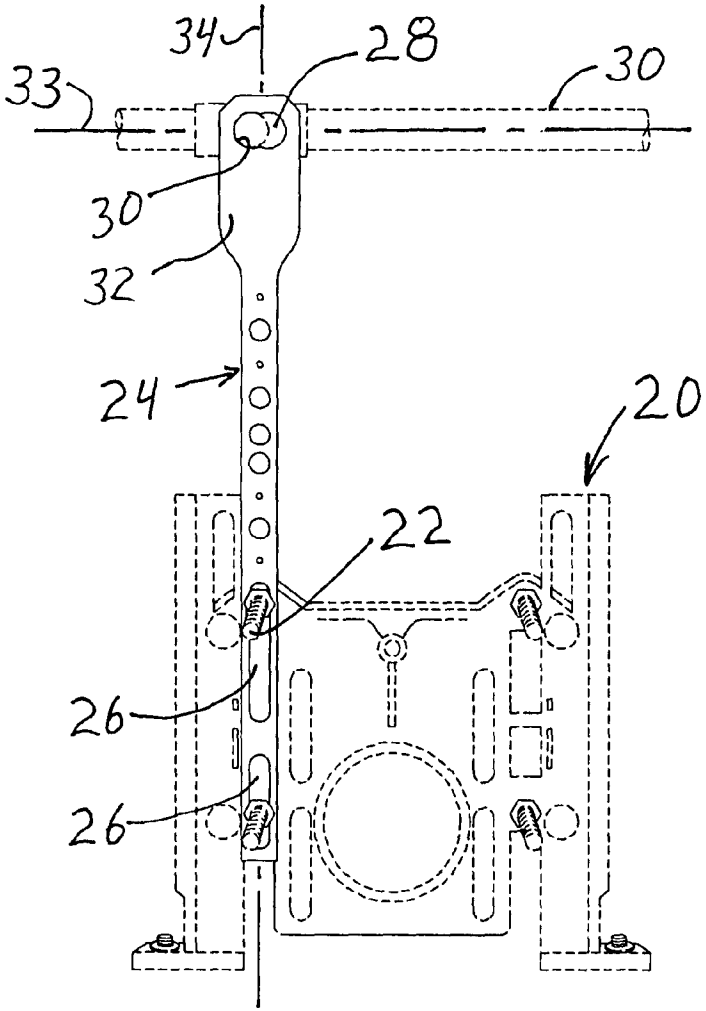
FIG. 8 is a front view of the bracket of FIG. 1 installed on a left side of a mounting fixture.

Referring to FIGS. 1 and 8, a water closet fixture 20 is fastened to a floor, and has threaded fasteners 22 such as bolts extending horizontally or generally parallel to the floor. A bracket 24 is mounted to the bolts 22 by passing the bolts 22 through appropriately located and sized apertures 26, such as holes or slots and tightening a threaded nut thereon. The bracket 24 has a shaped opening 28 sized and located to allow the passage of a tube 30. For illustration purposes, the tube 30 will be referred to herein as water inlet conduit 30 which is typically a water pipe having an outer diameter of about ¾ inch to about 1 inch. The water conduit 30 typically runs through a structural wall, and has an elbow or T section extending away from the wall and through the shaped opening 28 of the bracket 28. The water closet (e.g., toilet, urinal) that fastens to the fixture 20 and water conduit 30 is not shown, but typically has an inlet tube or fitting with which the water conduit 30 must align.

Referring to FIGS. 2-5 and 8, the bracket 24 for this application comprises an elongated member having a first, fastening end for fastening to a water closet support fixture 20. Opposite the first end, the bracket has a broader, generally flat distal end 32 in which the shaped opening 28 is formed. Advantageously the shaped opening 28 is contained entirely within and surrounded by the distal end 32. The shaped opening 28 is formed by a plurality of overlapping circles, with the illustrated opening being formed of two overlapping circles located on a common centerline 33 (FIG. 3) that is generally perpendicular to a longitudinal axis 34 of bracket 24, and that is preferably along a horizontal axis when in use with the depicted mounting fixture 20. Each circle has a diameter slightly larger than the diameter of the tube that will pass through the shaped opening 28 when in use.

For a conduit 30 with an outer diameter of about 1 inch, each overlapping circle has a diameter of about 1 inch, and preferably slightly larger to allow a slip fit of the conduit through the shaped opening 28. The overlapping circles are preferably spaced laterally apart along centerline 33 a distance corresponding to the radius of each circle, which for the illustrated embodiment is about 0.5 inches. That produces a shaped opening 28 resembling a FIG. 8, or resembling a short, elongated opening with a doubly curved protrusion or cusp in the middle of each side.

Figure 10:
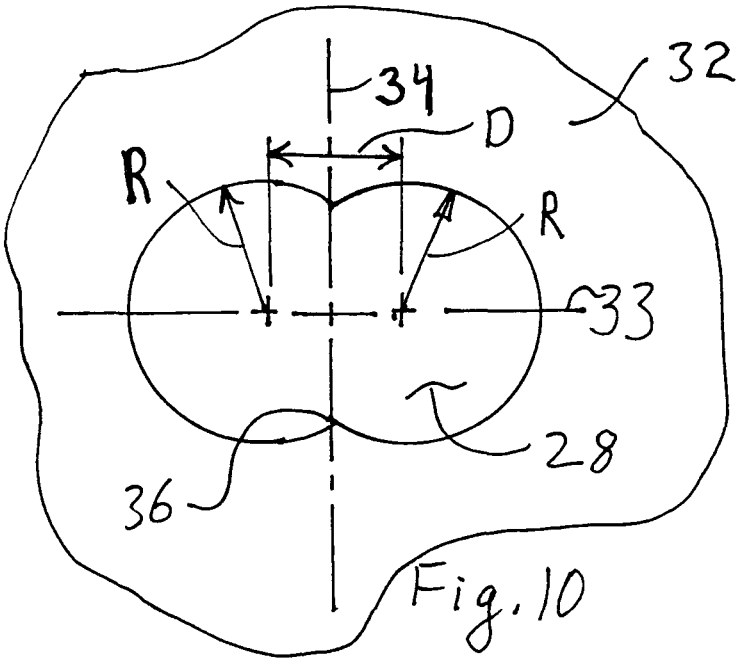
FIG. 10 is a cut-out view of the shaped opening in the bracket of FIG. 1.

Referring to FIG. 10, the overlapping circles are preferably of the same radius "R" with the centers of each openings being located on a common axis 33, and with the openings offset a distance D. That offset distance D is about 0.8R to about 1.8R, and preferably about 0.8R to 1.4R and ideally about the same as the radius R of the openings. Thus, each of the overlapping circles is laterally offset along axis 33 a distance D that corresponds to half the diameter of the circle. In the illustrated embodiment the offset is about half the diameter of the conduit 30, or about 0.5 inches for a one inch diameter conduit 30, and about ⅜ of an inch for a ¾ inch diameter water conduit 30.

The overlapping circles produce a cycloid shape, with a cusp 36 at the points of overlap. The cusp 36 is preferably rounded or broken to prevent a sharp point that may damage the tubes passing through the shaped opening 28. As desired, a flattened area can be provided at the cusp 36. The shaped opening 28 is contained entirely within the distal end 32, with sufficient distance between the opening 28 and the periphery of the distal end to provide a sufficiently strong support for the tube, such as conduit 30, which may pass through the shaped opening 28.

Figure 2:
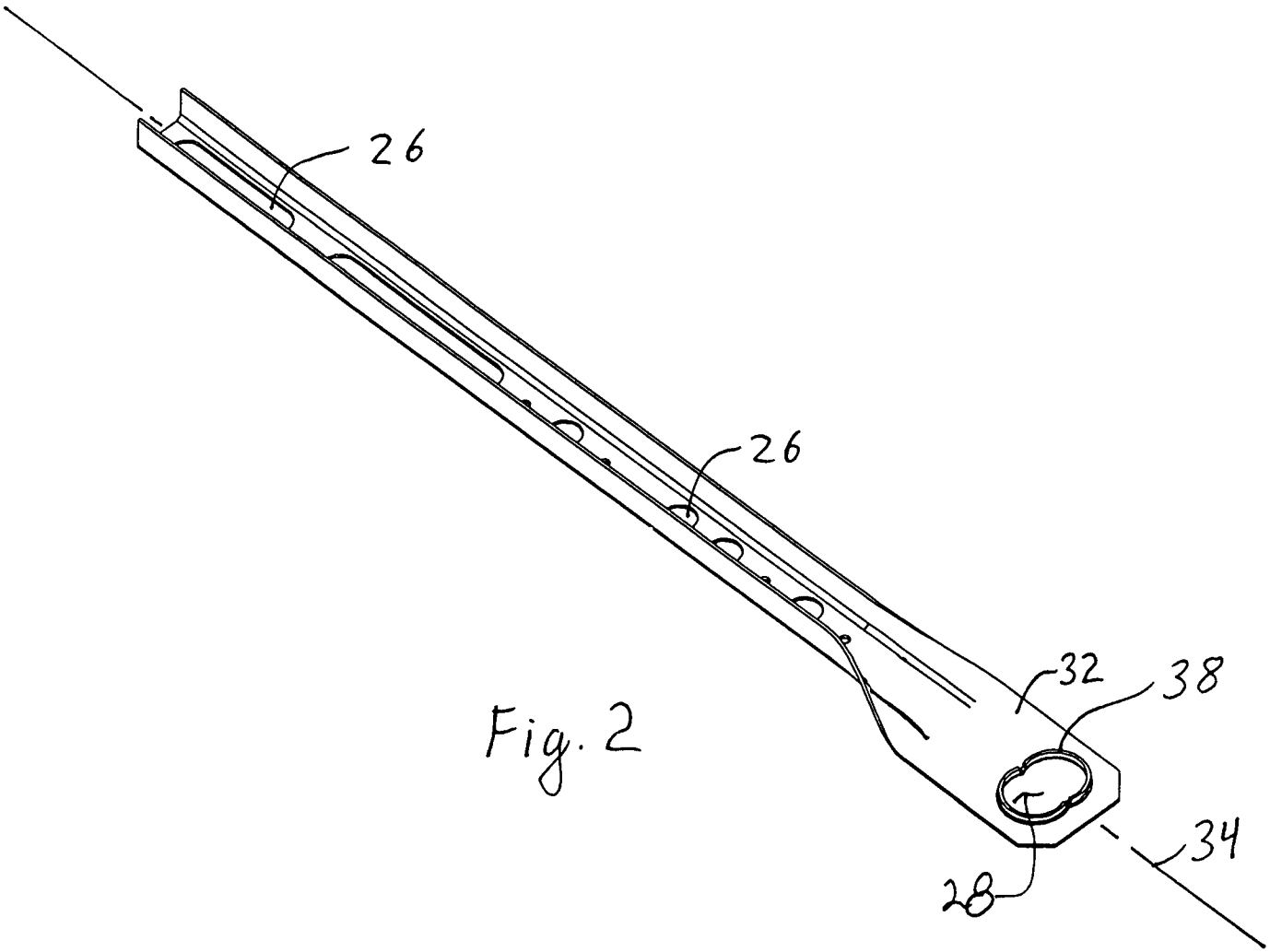
FIG. 2 is a back perspective view of the bracket of FIG. 1.

Referring to FIGS. 1-2 the bracket 24 preferably has a fastening portion shaped to increase the stiffness while reducing weight. A U-shaped cross section, as seen in FIGS. 1-2 and 6-7 is believed suitable. This general shape is sometimes called a channel section or a C section. The apertures 26 are formed in the bottom of the "U" which is preferably in the same plane as the broadened head 32 which contains the shaped opening 28. The legs of the "U" are perpendicular to the distal end or head 32 and have a gradual transition between the head 32 and the U-shaped section. The U-shape gives the bracket 24 added strength, while the broader width of the flattened portion at distal end 32 allows the shaped opening 28 to be formed within the distal end. Other cross sectional shapes can be used to provide a strengthened fastening section for fastening to the fixture 20 or other structural support, including open and closed box sections.

Figures 3, 4, 5, 6, 7:
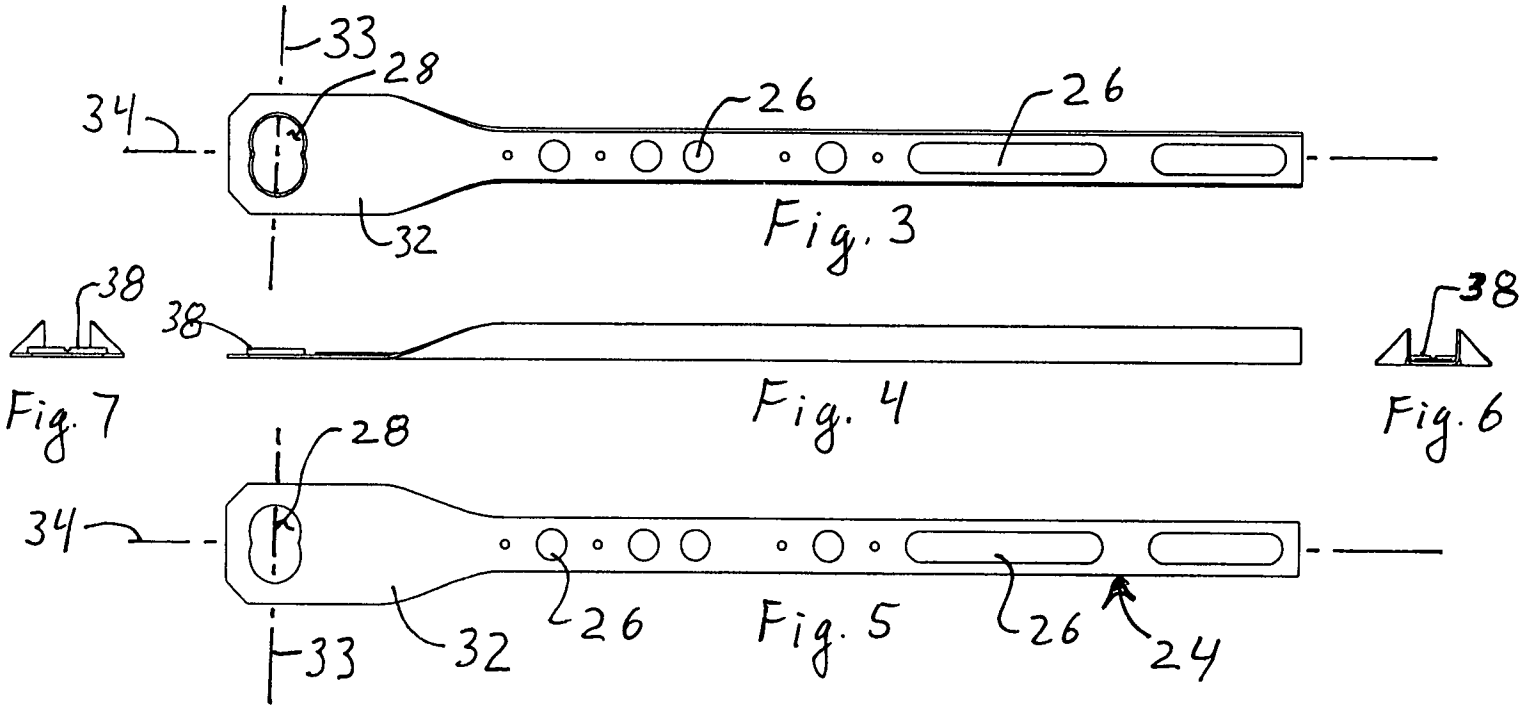
FIG. 3 is a plan view of the front of the bracket of FIG. 1.
FIG. 4 is a side view of the bracket of FIG. 3, with the opposing side being the mirror image.
FIG. 5 is a plan view of the back of the bracket of FIG. 3.
FIG. 6 is a plan view of the right or top end of the bracket of FIG. 3.
FIG. 7 is a plan view of the left or bottom end of the bracket of FIG. 3.

Referring to FIGS. 1, 2 and 4, the shaped opening 28 advantageously has a lip 38 around its periphery, with the lip conforming to the shape of the periphery of the opening 28. The lip 38 preferably does not extend along the apex of the cusp 36 so as to avoid a sharp edge that may damage any tube placed through the shaped opening 28. A lip having a length of about ⅛ to ¼ inch is believed suitable, but shorter or longer lengths may be used depending in part on the size of the shaped opening 28 and the nature of the tube passing through the shaped opening.

Figure 9:
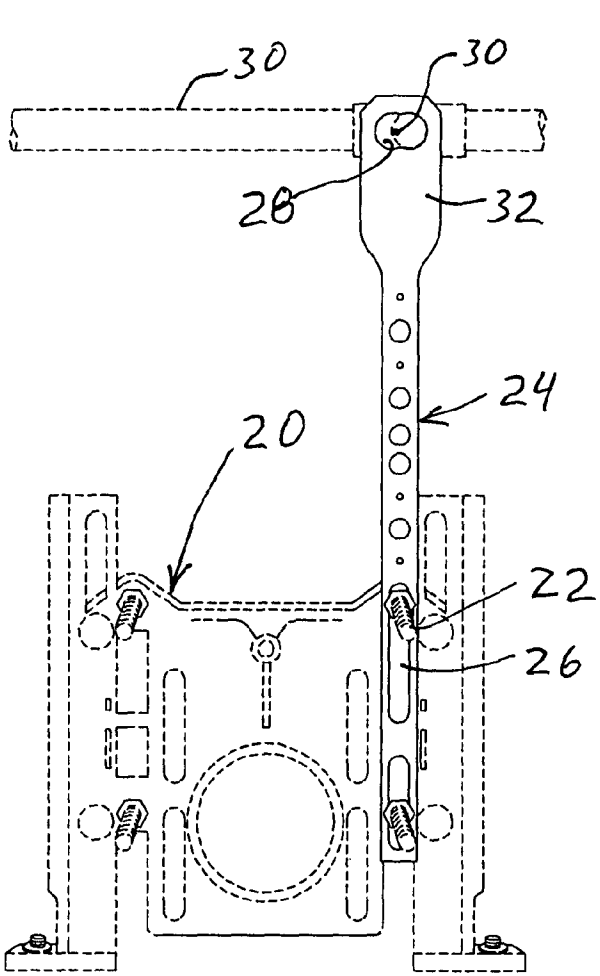
FIG. 9 is a front view of the bracket of FIG. 1 installed on a right side of a mounting fixture.

Referring to FIG. 8, when the water closet is fastened to the mounting fixture 20, the water closet will have a predetermined attachment location for the water conduit 30. The apertures 26 allow the vertical alignment of the shaped opening 28 to correspond with the vertical position of the water inlet on the water closet. The shaped opening 28 allows lateral adjustment of the connection to the water inlet, by allowing the inlet conduit 30 to be placed through either of two portions of the shaped opening 28. Placement of the tubular conduit 30 through one side of the shaped opening makes the adjacent portion of the shaped opening unsuitable for accepting the passage of a tube sized to fit the opening 28, because the tubular conduit 30 extends into the circular area occupied by the adjacent portion of the shaped opening 28. As seen in FIG. 8, placing the tubular conduit 30 in the left portion of the shaped opening 28 causes the tubular conduit 30 to extend into the adjacent circular portion of the opening 28 because of the overlapping circles used to form the shaped opening 28. Similarly, referring to FIG. 9, placing the tubular conduit 30 in the right side of the shaped opening 28 makes the left side of the opening 28 too small to accept another tubular conduit 30 of the same size or even of a substantially similar size.

As seen in FIGS. 8 and 10, the crest shaped juncture or cusps 36 formed by the overlapping circles are directly opposite each other and extend along axis 34 a distance sufficient to prevent the tubular conduit 30 from moving laterally along axis 33. The curved shape of the juncture leading up to the cusp 36 avoids sharp or inclined edges that may damage the tubular conduit 30. The spacing between the opposing junctures 36 is also sufficiently small relative to the diameter of the conduit 30 that the tubular conduit is not able to move laterally along axis 33 past the junctures of the overlapping circles resulting in cusps 36. To change the lateral location of the conduit 30, the tubular conduit 30 is removed from one side of the shaped opening 28 and then inserted into the other side along an axis orthogonal to the axes 33, 34 and perpendicular to the plane defined by axes 33, 34.

Because the shaped opening is formed entirely within the distal end or head 32, there are no separable parts that need to be loosened, removed or tightened in order to allow a shifting of position. The shaped opening 28 also encircles a majority of the circumference of the tubular conduit 30 which advantageously provides a sufficient surface to glue, solder or weld the conduit to the edges of the shaped opening to more securely hold the conduit. Advantageously the overlapping circles forming the shaped opening 28 provide a circular opening having an edge that subtends an arc of about 190°, and preferably have an edge that subtends an arc of about 190° to 240°, although a larger subtended arc could be used to more completely encircle the tubular conduit 30.

The shaped opening 28 supports the bottom of the tubular conduit 30 where gravity urges the conduit against the edges of the shaped opening 28. Providing a lip around at least this bottom portion of the periphery of the opening 28 can help reduce any damage or abrasion caused by the edge of the opening 28 contacting the tubular conduit 30. The amount of overlap of the adjacent circles that form the shaped opening 28 affects the support on the bottom of the opening 28 where gravity urges the conduit 30 against the edges forming the opening 28. In FIGS. 8 and 10 the bracket 24 is oriented so the longitudinal axis 34 is vertical, and in this orientation the bottom of the shaped opening 28 preferably supports an arc of about 60° or more of the bottom most portion of the conduit 30, measured symmetrically about the vertical axis. A larger or smaller portion will be supported depending on the distance D between the centers of the overlapping circles forming the shaped opening 28 and depending on the shape of the crescent shaped juncture 36.

Referring to FIGS. 1-2 and 3-9, the apertures 26 in the bracket 24 can have various shapes and sizes, depending on how the bracket is to be used. The use of elongated slots allows positioning of the bracket along axis 34, which in the illustrated embodiment is vertical. The use of repeated holes 26 or hole patterns allows incremental positioning of the bracket corresponding to the spacing of the holes. The use of different sized holes allows the bracket 24 to accommodate different bolt sizes, or allows nails or screws to pass through the appropriately sized aperture 26 in order to secure the bracket 24 to the mounting fixture 20 or to appropriate supporting structure (not shows) such as studs in a wall.

The bracket 24 is preferably formed of a single piece of material. The bracket 24 can be formed from sheet metal or molded material such as suitably strong plastics. The bracket can have various shapes. The illustrated bracket 24 can be made of sheet metal by punching the various apertures 26 and shaped opening 28 in a sheet of metal. The metal can be cut into strips before or after the apertures 26 and opening 28 are formed. The strip of metal can then be bent to form the stiffened U-shaped portion or box-shaped portion or other stiffening shape or other mounting shape, as desired. The lip 38 can be formed during the initial punching operation that forms the shaped opening 28, or alternatively the initial opening 28 can be punched slightly smaller, and a subsequent operation can enlarge the opening while deforming the sheet metal to form the lip 38. As needed, stiffening ridges or flanges can be formed on the head 32. The illustrated bracket 24 can be molded of suitable metal or plastic by shaping a mold to the desired configuration and injecting the molten material.

Figure 11:
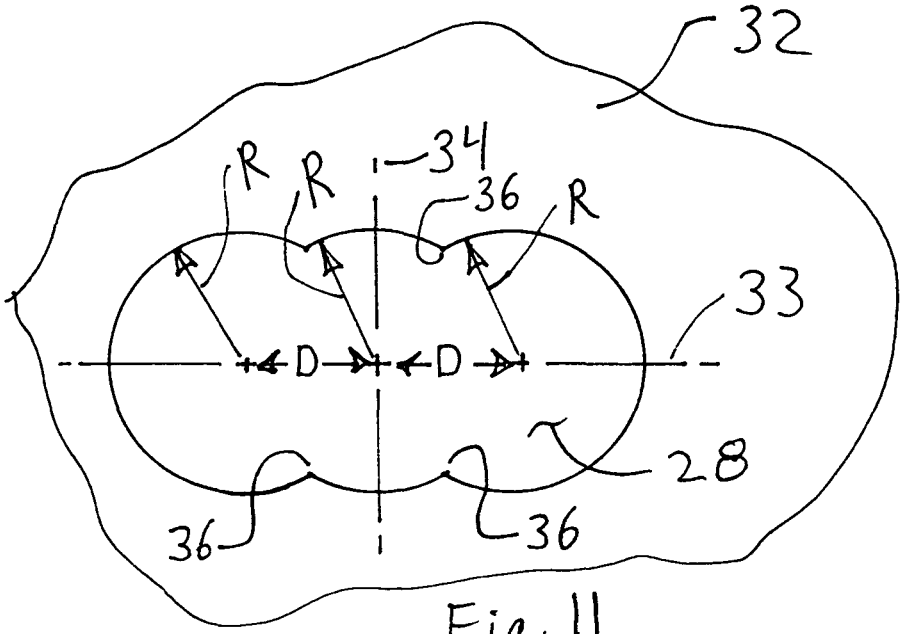
FIG. 11 is a cut-out view of an alternative embodiment of the shaped opening in the bracket of FIG. 1.

Referring to FIGS. 10-11, while the shaped opening 28 is preferably formed to have only two overlapping circles, it can have more. FIG. 11 illustrates the shaped opening 28 formed of three overlapping circles, each having the same radius R, with the centerline of each opening spaced the same distance apart, with opposing cusps 36 at the location where the circles overlap. A lip 38 could be provided as desired, but is not shown. The use of three overlapping circular openings to form the shaped opening 28 makes it easier to see the cycloid shape on the two opposing edges that form the opening 28.

The shaped opening of FIG. 11 allows a tubular conduit 30 to be placed in either of three lateral positions formed by shaped opening 28 and held in position by the edges of the shaped opening and bracket 24. Placing the tubular conduit 30 in one opening prevents the same sized conduit from being placed in an adjacent opening. Thus, if the conduit 30 is placed in the left opening as shown in FIG. 11, another conduit 30 of the same size could not be placed in the adjacent middle opening, but could be placed in the right side opening. Likewise, if the conduit 30 is placed in the right opening as shown in FIG. 11, another conduit 30 of the same size could not be placed in the adjacent middle opening, but could be placed in the left side opening. If the conduit 30 is placed in the middle opening, then no similarly sized conduit 30 could be placed in either adjacent openings on the left or right.

While each of the circles forming the shaped opening 28 could be made a different diameter, each circle preferably has the same diameter. While each of the circles forming the shaped opening 28 could be spaced a different distance D apart, preferably each opening is spaced the same distance D apart. While the axis 33, on which is located the center of the circles forming the shaped opening 28, could be orientated at any angle relative to axis 34, the axes 33, 34 are preferably perpendicular. Thus, the apertures 26 allow variable positioning of the shaped opening 28 along the axis 34, and the overlapping holes or openings forming shaped opening 28 allow variable positioning the conduit 30 along the axis 33. There is thus advantageously provided means on the bracket 24 for providing lateral positioning of the conduit 30 along axis 33. The various apertures 26 also provide means for vertical positioning of the conduit 30 along axis 34. The lateral positioning means include the shaped opening 28 having two opposing sides with cycloid shaped edges. The lip 38 provides means for increasing the area of support around the periphery of the shaped opening, and the preferably lip extends only along the opposing sides of the cycloid, or the lip may extend around the circular ends of the shaped opening 28.

In use, the fastening end of the bracket is fastened to the fixture 20 to which the water closet will be mounted. The vertical positioning of the shaped opening 28 is adjusted as needed using apertures 26 to align the shaped opening 28 with the desired location of the inlet to the water closet and/or the water conduit 30. The water closet may be temporarily placed on the fixture 20 to verify the desired location of the water conduit 30 and the vertical and lateral positioning of the shaped opening 28. The water conduit 30 is then placed through the appropriate portion of the shaped opening 28 and ultimately connected to the inlet on the water closet. If lip 38 is provided, an adhesive may be placed on the lip or otherwise interposed between the lip and the water conduit 30 so as to fasten the lip to the conduit. If the bracket 24 is metal, solder, brazing, welding, adhesives etc. may be used to fasten the lip 38 to the conduit 30.

Figure 12:
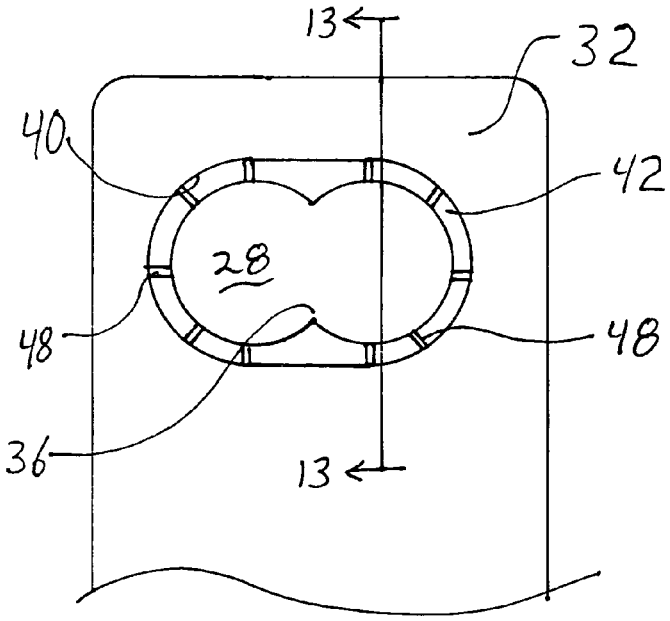
FIG. 12 is a plane view of an alternative embodiment of an insert forming the shaped opening in the bracket of FIG. 1.
Figure 13:
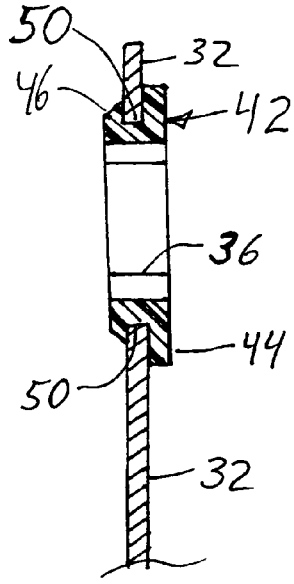
FIG. 13 is a sectional view taken along section 13-13 of FIG. 12.

A further embodiment of the shaped opening 28 is shown in FIGS. 12-13. In this further embodiment the distal end 32 has an opening 40 into which is fastened an insert 42. The insert 42 has a shaped opening 28 as described above. The insert 42 advantageously has a larger thickness than the thickness of the distal end 32 so as to provide a larger area of contact with and support to the conduit 30 that extends through the shaped opening 28 of the insert 42. While the insert 42 is shown with two overlapping circular holes, more overlapping openings can be used as discussed above.

Referring to FIG. 13, the insert 42 has a first flange 44 that is larger than the opening 40 in the distal end 32, so the insert cannot pass entirely through the opening 40. Opposite the first flange 44 is a second, smaller flange 46 that has a tapered edge. The second flange 46 is larger than the opening 40, but small enough that the tapered edge allows the second flange to be pushed through the opening 40. A plurality of outwardly extending slots 48 may be provided in the second flange 46 in order to separate the flange 46 into a plurality of flexible segments or fingers which provide sufficient flexibility in the insert 42 for the second flange 46 to pass through the opening 40. Between the flanges 44, 46 and in the plane of the insert 42 is a slot 50 into which the distal end 32 fits when the smaller, second flange is pushed through the opening 40. The inward movement of the second flange 46 allows the insert 42 to be snap locked to the opening 40.

The insert 42 is preferably, but optionally made of plastic, such as PVC or ABS plastic. The insert allows a single sized opening 40 to allow the shape and size of the shaped opening 28 to be varied. Thus, a single sized opening 40 could accommodate an insert having two overlapping circles of one inch diameter, or another insert having two overlapping circles of ¾ inch diameter, or an insert with different spacing between the overlapping circles, or an insert with various numbers of overlapping openings forming shaped opening 28. This further embodiment thus allows a worker to vary the shaped opening 28 at the time of installation in order to suit the size and location of the water conduit 30.

Figure 14:
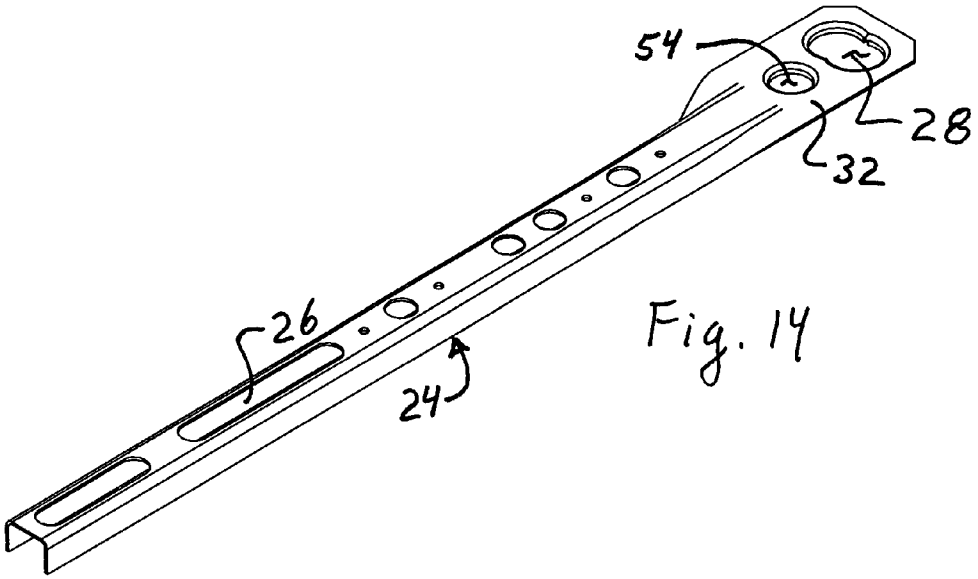
FIG. 14 is a perspective view of a further embodiment of the bracket of FIG. 1.
Figure 15:
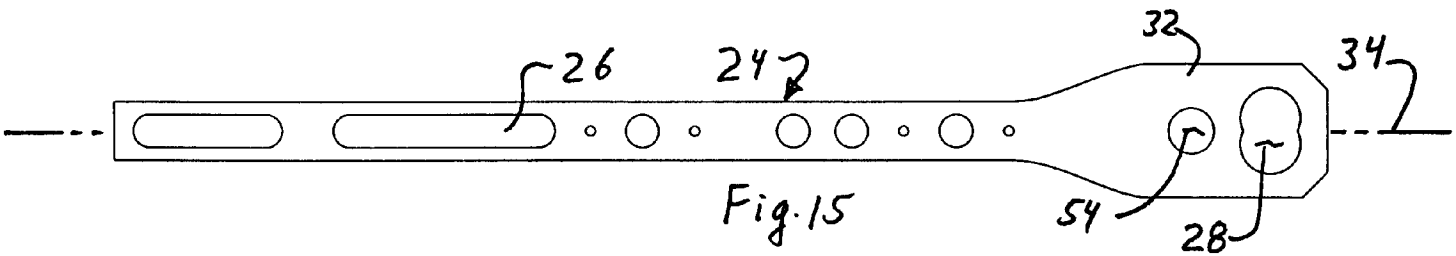
FIG. 15 is a top plan view of the embodiment of FIG. 14.
Figure 16:
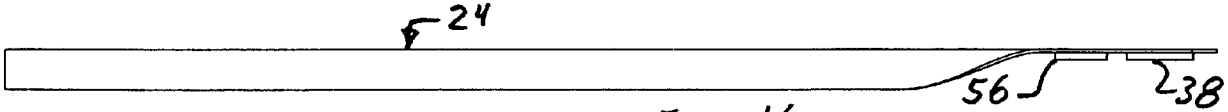
FIG. 16 is a side plan view of the embodiment of FIG. 14.

Referring to FIGS. 14-16, a further embodiment of the bracket 24 is shown having an additional hole or opening 54. The additional opening 54 can be of various sizes and shapes, but is preferably circular and sized to receive a plumbing line associated with the fixture to which the bracket 24 is fastened. An opening 54 about ⅞ inches diameter, give or take about ¼ inch, is preferred. Advantageously the opening 54 accommodates a ⅞ inch diameter tube, such as a urinal water line, when the bracket 24 is used with a urinal fixture 20. The opening 54 is advantageously, but optionally, centered on the longitudinal axis 34 (FIG. 15) although the opening 54 could be on either side of the axis, but preferably overlaps with that axis 34. The opening 54 is spaced apart from the shaped opening 28 a distance sufficient to provide sufficient structural support for the tubes or pipes passing through those openings 28 and 54.

A lip 56 (FIG. 16) surrounds the periphery of the hole 54 and depends from the head 32. The lip 56 can be formed from punching and deforming a portion of the head to form the hole 54. The lip 56 is optional, but forming a lip 56 around the periphery of opening 54, with the lip conforming to the shape of the periphery of the opening 54, is preferred. A lip 56 having a length of about ⅛ to ¼ inch is believed suitable, but shorter or longer lengths may be used depending in part on the size of the opening 56 and the nature of the tube passing through that opening. Additionally, in instances where it may be desirable to solder, braze, weld or otherwise adhere tubular conduit 30 into opening 54, the lip 56 provides an increased surface area for an enhanced bond. The same applies to lip 38. Providing lip 56 around at least a bottom portion of the periphery of the opening 54 can help reduce any damage or abrasion caused by the edge of the opening 54 contacting the tubular conduit 30 passing through the opening. The lip 56 thus preferably, but optionally, extends around at least 20-40% of the periphery of the opening 54, and preferably extends around about ¼ of that opening, preferably on the bottom so that a pipe passing through the opening will rest on the lip. The lip 56 can be formed during the initial punching operation that forms the opening 54, or alternatively the initial opening 54 can be punched slightly smaller, and a subsequent operation can enlarge the opening while deforming the sheet metal to form the lip 56. Alternatively, the opening 54 can be cut or formed by other known means and the lip 56 omitted, or soldered or welded in place.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

The above description is given by way of example, and not limitation. Given the above disclosure, one skilled in the art could devise variations that are within the scope and spirit of the invention, including various ways of orientating the shaped openings 28 in the head 32 of the bracket 24. While the bracket 24 is described being used in a specific application and with the head 32 being vertically oriented, the bracket 24 can be used in any orientation and a variety of applications where tubular structures such as pipes, electrical conduit and other elongated members are to be supported. Further, the various features of this invention can be used alone, or in varying combinations with each other and are not intended to be limited to the specific combination described herein. Thus, the invention is not to be limited by the illustrated embodiments but is to be defined by the following claims when read in the broadest reasonable manner to preserve the validity of the claims.

What is claimed is:

1. A support bracket for an elongated member, the elongated member extending along a longitudinal axis and having a generally uniform circular cross section of a radius about R, comprising an elongated member having a distal end completely containing and surrounding a shaped opening extending through the distal end, the opening formed by two overlapping circles of a radius of about R or slightly larger to allow passage of the elongated member through one of the circles at a time, the circles having centers spaced a distance apart less than twice the radius R, a line through the center of the circles being generally perpendicular to the longitudinal axis, the overlapping circles joining at a juncture located a distance from the centerline that is smaller than the radius R, wherein the juncture has a cusp that is rounded; and wherein the bracket has at least one aperture sized to allow the passage of a fastener to fasten the bracket to a water closet mounting fixture having a plurality of bolts at predetermined, standard locations, during use of the bracket.

2. The support bracket of claim 1, wherein the circles forming the shaped opening are spaced apart a distance less than about 1.8R.

3. The support bracket of claim 1, wherein the circles forming the shaped opening are spaced apart a distance of between about 0.8R and 1.8R.

4. The support bracket of claim 1, wherein the circles forming the shaped opening are spaced apart a distance of about the radius R.

5. The support bracket of claim 1, wherein the shaped opening has an edge with a lip extending from the edge.

6. The support bracket of claim 1, wherein the shaped opening is formed in an insert fastened to the distal end.

7. The support bracket of claim 1, further comprising an additional opening formed in the distal end separate and apart from the shaped opening, the additional opening being circular and overlapping a longitudinal axis extending the length of the support bracket.

8. The support bracket of claim 1, wherein the opening is formed by three overlapping circles.

9. A support bracket for an elongated member having a generally uniform circular cross section of a radius about R, comprising an elongated member having a distal end containing a shaped opening extending through the distal end and formed by two overlapping circles of the same radius R and spaced a distance apart less than the twice the radius, the overlapping circles joining at a juncture located a distance from the centerline that is smaller than the radius R, wherein the shaped opening has an edge with a lip extending from the edge and encircling at least a portion of each overlapping circle, the elongated member having at least one aperture sized and located therein to allow the bracket to be fastened to bolts on a water closet fixture during use of the bracket.

10. A support bracket for an elongated member, the elongated member extending along a longitudinal axis and having a generally uniform circular cross section of a radius about R, comprising an elongated member having a distal end completely containing and surrounding a shaped hole through the distal end, the hole formed by two overlapping circles of a radius of about R or slightly larger to allow passage of the elongated member through only one of the circles at a time, the circles having centers spaced a distance apart less than twice the radius R, a line through the center of the circles being generally perpendicular to the longitudinal axis, the overlapping circles joining at a juncture located a distance from the centerline that is smaller than the radius R; and wherein the elongated member has a first end opposite the distal end with the first end configured to fasten the bracket to a water closet mounting fixture having a plurality of bolts at predetermined locations, during use of the bracket; and wherein the hole has an edge with a lip extending from the edge and encircling at least a portion of each overlapping circle.

11. The support bracket of claim 10, wherein the fastening end is configured to provide means for fastening the bracket to the water closet.

12. The support bracket of claim 10, wherein the juncture forms a cusp that has a flattened area at the cusp.

13. The support bracket of claim 10, wherein the juncture forms a cusp and that cusp is rounded.

14. A support bracket for an elongated member, the elongated member extending along a longitudinal axis and having a generally uniform circular cross section of a radius about R, comprising an elongated member having a distal end completely containing and surrounding a shaped opening extending through the distal end, the opening formed by two overlapping circles of a radius of about R or slightly larger to allow passage of the elongated member through one of the circles at a time, the circles having centers spaced a distance apart less than twice the radius R, a line through the center of the circles being generally perpendicular to the longitudinal axis, the overlapping circles joining at a juncture located a distance from the centerline that is smaller than the radius R; and wherein the bracket has at least one aperture sized to allow the passage of a fastener to fasten the bracket to a water closet mounting fixture having a plurality of bolts at predetermined, standard locations, during use of the bracket; and wherein the shaped opening has an edge with a lip extending from the edge.

15. A support bracket for an elongated member, the elongated member extending along a longitudinal axis and having a generally uniform circular cross section of a radius about R, comprising an elongated member having a distal end completely containing and surrounding a shaped opening extending through the distal end, the opening formed by two overlapping circles of a radius of about R or slightly larger to allow passage of the elongated member through one of the circles at a time, the circles having centers spaced a distance apart less than twice the radius R, a line through the center of the circles being generally perpendicular to the longitudinal axis, the overlapping circles joining at a juncture located a distance from the centerline that is smaller than the radius R; and wherein the bracket has at least one aperture sized to allow the passage of a fastener to fasten the bracket to a water closet mounting fixture having a plurality of bolts at predetermined, standard locations, during use of the bracket; and wherein the juncture is cusp that has a flattened area at the cusp.

16. A support bracket for an elongated member, the elongated member extending along a longitudinal axis and having a generally uniform circular cross section of a radius about R, comprising an elongated member having a distal end completely containing and surrounding a shaped hole through the distal end, the hole formed by two overlapping circles of a radius of about R or slightly larger to allow passage of the elongated member through only one of the circles at a time, the circles having centers spaced a distance apart less than twice the radius R, a line through the center of the circles being generally perpendicular to the longitudinal axis, the overlapping circles joining at a juncture located a distance from the centerline that is smaller than the radius R; and wherein the elongated member has a first end opposite the distal end with the first end configured to fasten the bracket to a water closet mounting fixture having a plurality of bolts at predetermined locations, during use of the bracket; and wherein the juncture forms a cusp that has a flattened area at the cusp.

17. A support bracket for an elongated member, the elongated member extending along a longitudinal axis and having a generally uniform circular cross section of a radius about R, comprising an elongated member having a distal end completely containing and surrounding a shaped hole through the distal end, the hole formed by two overlapping circles of a radius of about R or slightly larger to allow passage of the elongated member through only one of the circles at a time, the circles having centers spaced a distance apart less than twice the radius R, a line through the center of the circles being generally perpendicular to the longitudinal axis, the overlapping circles joining at a juncture located a distance from the centerline that is smaller than the radius R; and wherein the elongated member has a first end opposite the distal end with the first end configured to fasten the bracket to a water closet mounting fixture having a plurality of bolts at, predetermined locations, during use of the bracket; and wherein the juncture forms a cusp and that cusp is rounded.

* * * * *